US005987840A

United States Patent [19]

Leppert

[11] Patent Number: 5,987,840

[45] Date of Patent: Nov. 23, 1999

[54] SELF-ALIGNING BLOCK

[76] Inventor: Jeffrey K. Leppert, 27 Shady La., Huntington, N.Y. 11743

[21] Appl. No.: 09/085,573

[22] Filed: May 28, 1998

[51] Int. Cl.[6] ..... E04B 2/08

[52] U.S. Cl. ..... 52/592.6; 52/592.5; 52/604

[58] Field of Search ..... 52/592.6, 592.5, 52/604; 446/117, 124, 476

[56] References Cited

U.S. PATENT DOCUMENTS

| | | | |
|---|---|---|---|
| 112,925 | 3/1871 | Johnson | 52/604 |
| 1,634,357 | 7/1927 | Himmelright | 52/604 |
| 2,861,388 | 11/1958 | Favaretto | 446/128 |
| 4,026,086 | 5/1977 | Langley | 52/582 |
| 4,297,816 | 11/1981 | Kella et al. | 52/125 |
| 4,436,447 | 3/1984 | Crowe . | |
| 4,639,345 | 1/1987 | Olsen . | |
| 4,965,979 | 10/1990 | Larrivee et al. | 52/585 |
| 4,990,116 | 2/1991 | Chen | 446/124 |
| 5,061,218 | 10/1991 | Garage et al. | 446/128 |
| 5,230,195 | 7/1993 | Sease | 52/593 |
| 5,350,256 | 9/1994 | Hammer . | |
| 5,421,135 | 6/1995 | Stevens et al. . | |
| 5,537,796 | 7/1996 | Kliethermes | 52/592.6 |
| 5,647,185 | 7/1997 | Forlini | 52/604 |
| 5,651,642 | 7/1997 | Kelley, Jr. et al. | 405/286 |
| 5,795,210 | 8/1998 | Kushner et al. | 446/128 |

*Primary Examiner*—Carl D. Friedman
*Assistant Examiner*—Dennis L. Dorsey
*Attorney, Agent, or Firm*—Richard L. Miller, P.E.

[57] ABSTRACT

A self-aligning block that includes a body that has at least one mortise therein, and at least one tenon that extends from the body. A respective tenon of one self-aligning block is received in a respective mortise in the bottom surface of the body of a next higher staggered the self-aligning block of one wall to a height that provides an automatic mortar space between the one self-aligning block and the next higher staggered self-aligning block from course to course of the one wall. That portion of the lateral alignment spacer that extends from the longitudinal alignment spacer to a respective tenon of one self-aligning block of one wall is higher than and is received by a respective longitudinal alignment recess in a respective side face of the body of a next higher staggered self-aligning block of a perpendicular wall, with a respective side face of the body of the next higher staggered self-aligning block of the one wall abutting against the longitudinal alignment spacer of the one self-aligning block of the perpendicular wall so as to assure proper longitudinal and lateral spacing between self-aligning blocks of the same course of perpendicular walls, while further assuring proper mortar spacing between courses of the perpendicular walls.

9 Claims, 2 Drawing Sheets

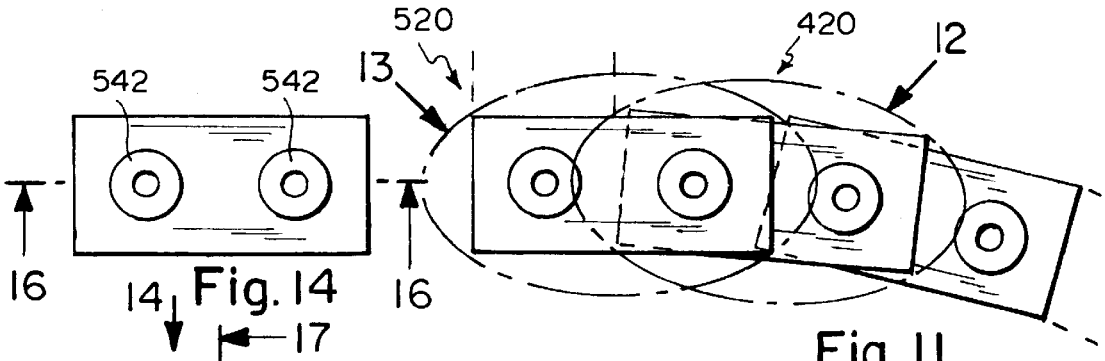
Fig. 14
Fig. 11
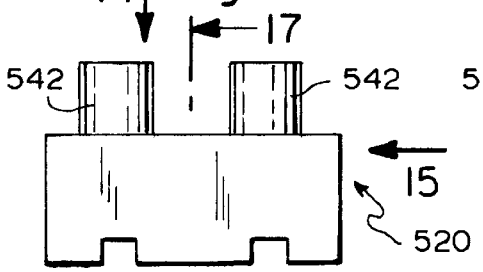
Fig. 13
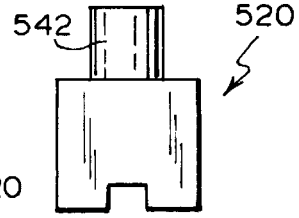
Fig. 15
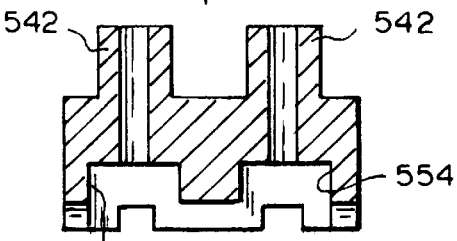
Fig. 16
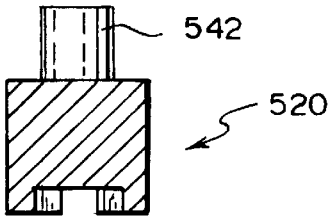
Fig. 17
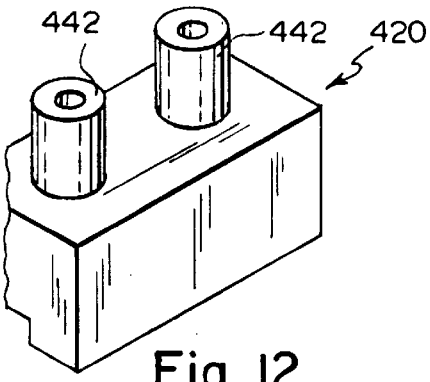
Fig. 12
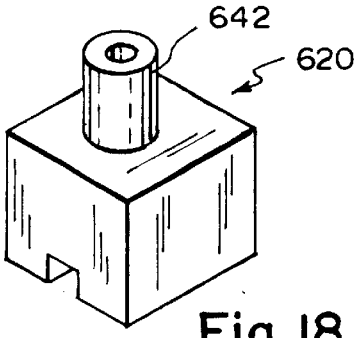
Fig. 18

SELF-ALIGNING BLOCK

BACKGROUND OF THE INVENTION

1. Field of the Invention

The present invention relates to a block. More particularly, the present invention relates to a self-aligning block.

2. Description of the Prior Art

Numerous innovations for blocks have been provided in the prior art that will be described. Even though these innovations may be suitable for the specific individual purposes to which they address, however, they differ from the present invention.

FOR EXAMPLE, U.S. Pat. No. 4,436,447 to Crowe teaches interlocking concrete blocks for controlling erosion of banks of bodies of water that are provided with improved wave resistance by providing pairs of spigots on one side of the block and a slot or slots on the other side of the block so as to allow longitudinal movement of courses in a bed formed from the blocks while also allowing relative angular movement of adjacent blocks.

ANOTHER EXAMPLE, U.S. Pat. No. 4,639,345 to Olsen teaches a dry wall interlocking building block system that includes a method of manufacturing molds for casting building blocks, in which master forms corresponding in shape and size to the required blocks are cast from a cold-pouring compound in collapsible core-boxes, and in which a mould is built up around the master forms by securing the forms to a casting table, placing metal liner plates against the sides of the forms, filling the spaces around the liner plates with a similar cold-pouring compound, allowing the compound to set, and withdrawing the forms to leave a plurality of mould cavities. The mould can then be mounted in a block making machine for large scale casting of concrete blocks in the mould cavities. One feature of the preferred mould is that the liner plates are detachable, countersunk bolts having been fitted in holes in the liner plates prior to filling the spaces around the plates. The invention also includes a two-recess building block cast in the above mould.

STILL ANOTHER EXAMPLE, U.S. Pat. No. 5,350,256 to Hammer teaches a retaining wall system constructed in several distinct layers. Each layer is formed of a side-by-side arrangement of I-shaped subassemblies with back fill chambers defined between each pair of subassemblies. Each subassembly is constructed of generally planar elongated concrete blocks which interconnect to laterally secure the blocks to one another. Interconnections are provided by dovetails joints in which a tongue is vertically slid into a groove to prevent lateral separation. The dovetail elements extend only partially across the face of each block so that the block defining the groove is not excessively weakened by the groove.

FINALLY, YET ANOTHER EXAMPLE, U.S. Pat. No. 5,421,135 to Stevens et al. teaches a modular-shaped, lightweight concrete block that can be pivotally interlocked with other blocks of the same size without having to use grout and pins or additional attachment apparatus. The building block comprises a pair of vertically aligned side faces and horizontally aligned top and bottom faces that are joined at opposite lateral ends with rounded end faces. A pair of tenons extend out the top face of the block at opposite lateral ends and are coaxially aligned with complementary mortises formed into the bottom face. The unique end face configuration in combination with the location of the tenon, allow two adjacent blocks to be interlocked together in a wide range of angles. The invention also includes a novel handle configuration that is located in the middle of the block.

It is apparent that numerous innovations for blocks have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a self-aligning block that avoids the disadvantages of the prior art.

ANOTHER OBJECT of the present invention is to provide a self-aligning block that is simple and inexpensive to manufacture.

STILL ANOTHER OBJECT of the present invention is to provide a self-aligning block that is simple to use.

BRIEFLY STATED, YET ANOTHER OBJECT of the present invention is to provide a self-aligning block that includes a body that has at least one mortise therein, and at least one tenon that extends from the body. A respective tenon of one self-aligning block is received in a respective mortise in the bottom surface of the body of a next higher staggered the self-aligning block of one wall to a height that provides an automatic mortar space between the one self-aligning block and the next higher staggered self-aligning block from course to course of the one wall. That portion of the lateral alignment spacer that extends from the longitudinal alignment spacer to a respective tenon of one self-aligning block of one wall is higher than and is received by a respective longitudinal alignment recess in a respective side face of the body of a next higher staggered self-aligning block of a perpendicular wall, with a respective side face of the body of the next higher staggered self-aligning block of the one wall abutting against the longitudinal alignment spacer of the one self-aligning block of the perpendicular wall so as to assure proper longitudinal and lateral spacing between self-aligning blocks of the same course of perpendicular walls, while further assuring proper mortar spacing between courses of the perpendicular walls.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 11 is a diagrammatic top plan view of the fourth and fifth embodiments of the present invention being utilized to erect a curved wall;

FIG. 12 is a diagrammatic perspective view of the area generally enclosed by the dotted ellipse identified by arrow 12 in FIG. 11 of a stretcher block of the fourth embodiment of the present invention;

FIG. 13 is a diagrammatic side elevational view of the area generally enclosed by the dotted ellipse identified by arrow 13 in FIG. 11 of a quoin block of the fifth embodiment of the present invention;

FIG. 14 is a diagrammatic top plan view taken generally in the direction of arrow 14 in FIG. 13;

FIG. 15 is a diagrammatic end elevational view taken generally in the direction of arrow 15 in FIG. 13;

FIG. 16 is a cross sectional view taken on line 16—16 in FIG. 14;

FIG. 17 is a cross sectional view taken on line 17—17 in FIG. 13; and FIG. 18 is a diagrammatic perspective view of a stretcher bat block of the sixth embodiment of the present invention.

LIST OF REFERENCE NUMERALS UTILIZED IN THE DRAWING

First Embodiment

Figures 1, 2, 3, 4, 5, 6, 7, 8, 9:
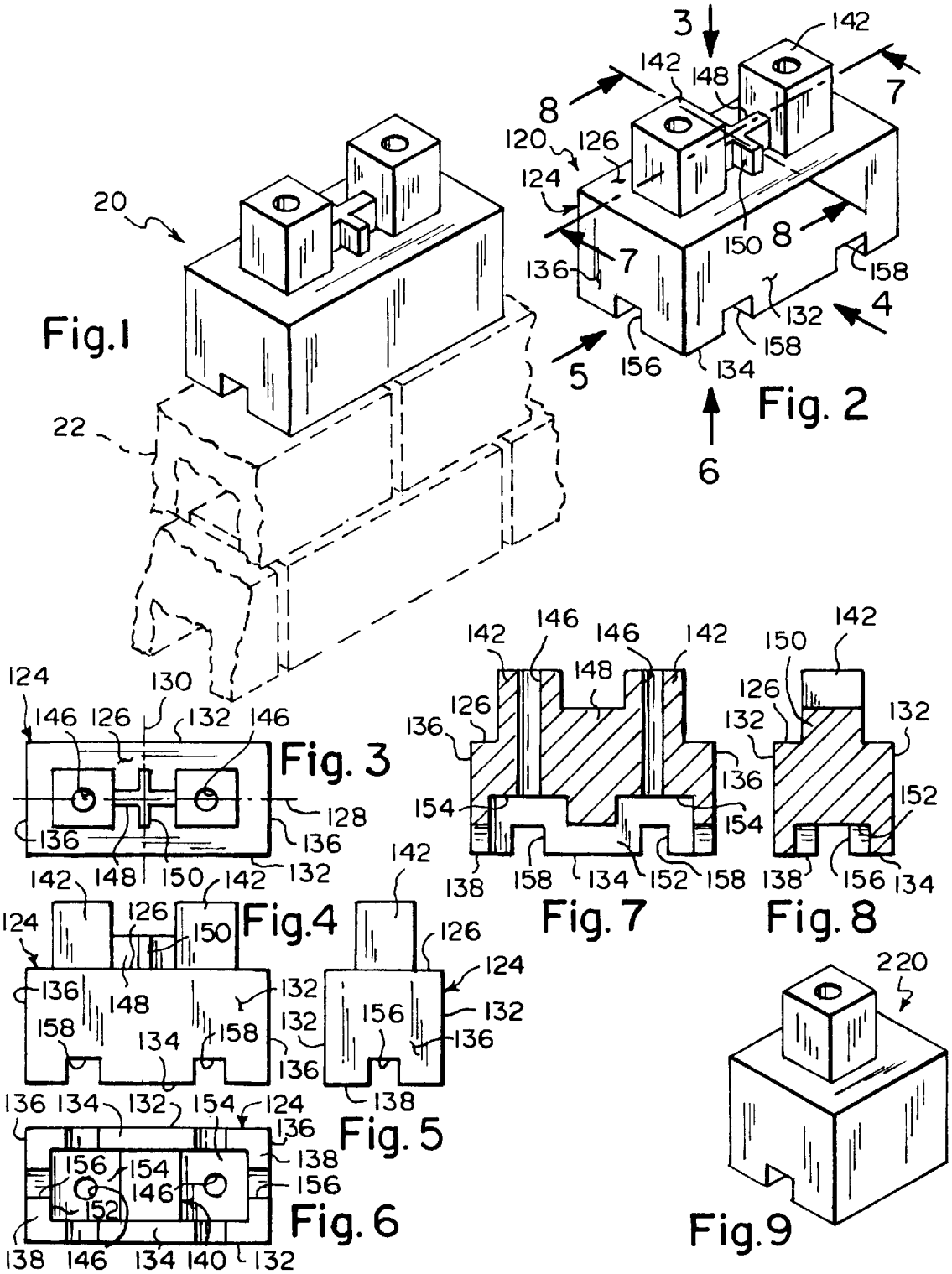
FIG. 1 is a diagrammatic perspective view of a stretcher block of the first embodiment of the present invention being utilized to erect a straight wall.
FIG. 2 is a diagrammatic perspective view of a quoin block of the second embodiment of the present invention.
FIG. 3 is a diagrammatic top plan view taken generally in the direction of arrow 3 in FIG. 2.
FIG. 4 is a diagrammatic side elevational view taken generally in the direction of arrow 4 in FIG. 2.
FIG. 5 is a diagrammatic end elevational view taken generally in the direction of arrow 5 in FIG. 2.
FIG. 6 is a diagrammatic bottom plan view taken generally in the direction of arrow 6 in FIG. 2.
FIG. 7 is a cross sectional view taken on line 7—7 in FIG. 2.
FIG. 8 is a cross sectional view taken on line 8—8 in FIG. 2.
FIG. 9 is a diagrammatic perspective view of a stretcher/bat block of the third embodiment of the present invention.

20 stretcher block of self-aligning block of present invention
22 straight wall

Second Embodiment

120 quoin block of self-aligning block of present invention
124 body of quoin block 120
126 top face of body 124 of quoin block 120
128 longitudinal center line of top face 126 of body 124 of quoin block 120
130 lateral centerline of top face 126 of body 124 of quoin block 120
132 pair of opposing side faces of body 124 of quoin block 120
134 bottom surfaces of pair of opposing side faces 132 of body 124 of quoin block 120
136 pair of opposing end faces of body 124 of quoin block 120
138 bottom surfaces of pair of opposing end faces 136 of body 124 of quoin block 120
140 bottom face of quoin block 120
142 pair of tenons of quoin block 120
146 throughbore in each tenon of pair of tenons 142 of quoin block 120
148 lateral alignment spacer of quoin block 120
150 longitudinal alignment spacer of quoin block 120
152 main recess in bottom face 140 of body 124 of quoin block 120
154 pair of mortises in bottom face 140 of body 124 of quoin block 120
156 lateral alignment recess in each end face of pair of opposing end faces 136 of body 124 of quoin block 120
158 pair of longitudinal alignment recess in each side face of pair of opposing side faces 132 of body 124 of quoin block 120

Third Embodiment

220 stretcher or bat block of self-aligning block of present invention

Fourth Embodiment

420 stretcher block of self-aligning block of present invention
442 pair of tenons of stretcher block 420

Fifth Embodiment

520 quoin block of self-aligning block of present invention
542 pair of tenons of quoin block 520
554 pair of mortises

Sixth Embodiment

620 stretcher or bat block of self-aligning block of present invention
642 tenon of stretcher or bat block 620

DESCRIPTION OF THE PREFERRED EMBODIMENT

Referring now to the figures in which like numerals indicate like parts, and particularly to FIG. 1, the stretcher block of the first embodiment of the self-aligning block of the present invention is shown generally at 20 being utilized to erect a straight wall 22.

Referring now to FIG. 2, the quoin block of the second embodiment of the present invention is shown generally at 120 and by definition is used to form a corner of a wall (not shown).

The configuration of the quoin block 120 can best be seen in FIGS. 2–8, and as such will be discussed with reference thereto.

The quoin block 120 comprises a body 124 that is rectangular-parallelepiped-shaped and has a top face 126 with a longitudinal center line 128 and a lateral centerline 130, a pair of opposing side faces 132 with bottom surfaces 134, a pair of opposing end faces 136 with bottom surfaces 138, and a bottom face 140.

The quoin block 120 further comprises a pair of tenons 142 that have a width and are rectangular-shaped and extend perpendicularly upwardly from the longitudinal center line 128 of the top face 126 of the body 124, spaced-apart, and inward of, the pair of opposing end faces 136 of the body 124.

Each tenon of the pair of tenons 142 has a throughbore 146 that extends longitudinally therethrough, colinearaly through the body 124, and communicates with the bottom face 140 of the body 124.

The quoin block 120 further comprises a lateral alignment spacer 148 that extends along the longitudinal center line 128 of the top face 126 of the body 124, from, and is thinner and lower than, one tenon of the pair of tenons 142 to, and is thinner and lower than, the other tenon of the pair of tenons 142.

The quoin block 120 further comprises a longitudinal alignment spacer 150 that perpendicularly intersects, and is as thin and as high as, the lateral alignment spacer 148, and extends along the lateral center line 130 of the top face 126 of the body 124, the width of the pair of tenons 142.

The bottom face 140 of the body 124 has a main recess 152 that is rectangular-parallelepiped-shaped, concentric therewith, and extends upwardly therein, and a pair of mortises 154 that are rectangular-parallelepiped-shaped.

Each mortise of the pair of mortises 154 in the bottom face 140 of the body 124 communicates with, and extends upwardly from the main recess 152 in the bottom face 140 of the body 124, is larger than, and is in alignment with, a respective tenon of the pair of tenons 142, and communicates with the throughbore 146 in the respective tenon of the pair of tenons 142.

Each end face of the pair of opposing end faces 136 of the body 124 has a lateral alignment recess 156 that is rectangular-parallelepiped-shaped and extends upwardly from, and communicates with, the bottom surface of a respective end face of the pair of opposing end faces 136 of the body 124, at its center, and communicates with the main recess 152 in the bottom surface 140 of the body 124.

Each side face of the pair of opposing side faces 132 of the body 124 has a pair of longitudinal alignment recess 158 that are rectangular-parallelepiped-shaped and extend upwardly from, and communicate with, the bottom surface 134 of a respective side face of the pair of opposing side faces 132 of the body 124, in longitudinal alignment with the pair of tenons 142, and further communicate with the main recess 152 in the bottom surface 140 of the body 124.

A respective tenon of the pair of tenons 142 of one self-aligning block 120 is received in a respective mortise of the pair of mortises 154 in the bottom surface 140 of the body 124 of a next higher staggered self-aligning block 120 of one wall to a height that provides an automatic mortar space between the one self-aligning block 120 and the next higher staggered self-aligning block 120 from course to course of the one wall.

The lateral alignment recess 156 in a respective end face of the pair of opposing end faces 136 of the body 124 of the next higher staggered self-aligning block 120 of the one wall is lower than, and receives that portion of, the lateral alignment spacer 148 that extends from the longitudinal alignment spacer 150 to a respective tenon of the pair of tenons 142 of the one self-aligning block 120 of the one wall, with a respective end face of the pair of opposing end faces 136 of the body 124 of the next higher staggered self-aligning block 124 of the one wall abutting against the longitudinal alignment spacer 150 of the one self-aligning block 120 of the one wall so as to assure proper longitudinal and lateral spacing between self-aligning blocks 120 of the same course of the one wall, while further assuring the proper mortar spacing between courses of the one wall.

A respective longitudinal alignment recess of the pair of longitudinal alignment recesses 158 in a respective side face of the pair of opposing side faces 132 of the body 124 of the next higher staggered self-aligning block 120 of the one wall is lower than, and receives that portion of, the lateral alignment spacer 148 that extends from the longitudinal alignment spacer 150 to a respective tenon of the pair of tenons 142 of the one self-aligning block 120 of a perpendicular wall, with a respective side face of the pair of opposing side faces 132 of the body 124 of the next higher staggered self-aligning block 124 of the one wall abutting against the longitudinal alignment spacer 150 of the one self-aligning block 120 of the perpendicular wall so as to assure proper longitudinal and lateral spacing between self-aligning blocks 120 of the same course of perpendicular walls, while further assuring proper mortar spacing between courses of the perpendicular walls.

The stretcher block 20 of the first embodiment of the present invention shown in FIG. 1 is similar to the quoin block 120, with the deletion of the pair of longitudinal alignment recesses 158 in the pair of opposing side faces 132 of the body by definition of a stretcher block not be utilized for corners.

As shown in FIG. 9, the stretcher or bat block 220 is similar to half the stretcher block 20 and is used either as a filler on a course or as a closure.

As shown in FIG. 11, the self-aligning blocks of the fifth and sixth embodiments of the present invention are shown generally at 420 and 520, respectively, and are utilized to erect a curved wall.

As shown in FIG. 12 the fourth embodiment of the present invention is a stretcher block 420 that is similar to the stretcher block 20, with the deletion of the lateral alignment spacer 148 and the longitudinal alignment spacer 150, and with the pair of tenons 442 and the pair of mortises (not shown) being cylindrically-shaped so as to allow adjacent self-aligning blocks 420 to pivot horizontally relative to each other to achieve the desired curve for the wall.

As shown in FIGS. 13–17, the fifth embodiment of the present invention is a quoin block 520 that is similar to the quoin block 120, with the deletion of the lateral alignment spacer 148 and the longitudinal alignment spacer 150, and with the pair of tenons 242 and the pair of mortises 554 being cylindrically-shaped.

As shown in FIG. 18, the sixth embodiment of the present invention is either a stretcher or a bat block 620 that is similar to the stretcher or bat block 220, with the tenon 642 and the mortise (not shown) being cylindrically-shaped and used when a half block or a closure is needed.

It will be understood that each of the elements described above, or two or more together, may also find a useful application in other types of constructions differing from the types described above.

While the invention has been illustrated and described as embodied in a self-aligning block, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-aligning block for forming at least one wall, comprising:

a) body having at least one mortise therein; said body being rectangular-parallelepiped-shaped and having a top face with a longitudinal center line and a lateral centerline, a pair of opposing side faces with bottom surfaces, a pair of opposing end faces with bottom surfaces, and a bottom face; said bottom face of said body having a main recess therein being rectangular-parallelepiped-shaped, concentric therewith, and extending upwardly therein, and each mortise of said at least one mortise being rectangular-parallelepiped-shaped; each end face of said pair of opposing end faces of said body having a lateral alignment recess therein being rectangular-parallelepiped-shaped and extending upwardly from, and communicating with, said bottom surface of a respective end face of said pair of opposing end faces of said body, at its center, and communicating with said main recess in said bottom face of said body; each side face of said pair of opposing side faces of said body having at least one longitudinal alignment recess therein being rectangular-parallelepiped-shaped and extending upwardly from, and communicating with, said bottom surface of a respective side face of said pair of opposing side faces of said body and further communicating with said main recess in said bottom face of said body;

b) at least one tenon extending from said body; each tenon of said at least one tenon having a throughbore extending longitudinally therethrough, colinearaly through said body, and communicating with said bottom face of said body; said at least one tenon being a pair of tenons spaced-apart, disposed on said longitudinal centerline of said top face of said body, and inward of said pair of opposing end faces of said body;

c) a lateral alignment spacer extending along said longitudinal centerline of said top face of said body, from, and being thinner and lower than, one tenon of said pair of tenons to, and being thinner and lower than, the other tenon of said pair of tenons;

d) a longitudinal alignment spacer perpendicularly intersecting, and being as thin and as high as, said lateral alignment spacer, and extending along said lateral centerline of said top face of said body; said lateral alignment recess in a respective end face of said pair of opposing end faces of said body of a next higher staggered self-aligning block of one wall being lower than and receiving that portion of said lateral alignment spacer extending from said longitudinal alignment spacer to a respective tenon of said pair of tenons of one self-aligning block of the one wall, with a respective end face of said pair of opposing end faces of said body of said next higher staggered self-aligning block of the one wall abutting against said longitudinal alignment spacer of said one self-aligning block of the one wall so as to assure proper longitudinal and lateral spacing between self-aligning blocks of the same course of the one wall, while assuring proper mortar spacing between courses of the one wall; that portion of said lateral alignment spacer extending from said longitudinal alignment spacer to a respective tenon of said pair of tenons of said one self-aligning block of the one wall being higher than and received by a respective longitudinal alignment recess of said at least one longitudinal alignment recess in a respective side face of said pair of opposing side faces of said body of said next higher staggered self-aligning block of a perpendicular wall, with a respective side face of said pair of opposing side faces of said body of said next higher staggered self-aligning block of the one wall abutting against said longitudinal alignment spacer of said one self-aligning block of the perpendicular wall so as to assure proper longitudinal and lateral spacing between self-aligning blocks of the same course of perpendicular walls, while further assuring proper mortar spacing between courses of the perpendicular walls.

2. The block as defined in claim 1, wherein said at least one tenon extends perpendicularly upwardly from said longitudinal center line of said top face of said body.

3. The block as defined in claim 1, wherein each mortise of said at least one mortise in said bottom face of said body communicates with, and extends upwardly from said main recess in said bottom face of said body, is larger than, and is in alignment with, a respective tenon of said at least one tenon, and communicates with said throughbore in said respective tenon of said at least one tenon.

4. The block as defined in claim 3, wherein a respective tenon of said at least one tenon of one said self-aligning block is received in a respective mortise of said at least one mortise in said bottom surface of said body of a next higher staggered said self-aligning block of one wall to a height that provides an automatic mortar space between said one self-aligning block and said next higher staggered self-aligning block from course to course of said one wall.

5. The block as defined in claim 1, wherein each tenon of said at least one tenon is cylindrically-shaped.

6. The block as defined in claim 1, wherein each tenon of said at least one tenon is rectangular-parallelepiped-shaped.

7. The block as defined in claim 1, wherein said at least one tenon is one tenon disposed at the intersection of said longitudinal centerline of said top face of said body and said lateral centerline of said top face of said body.

8. The block as defined in claim 1, wherein said at least one longitudinal alignment recess in each side face of said pair of opposing side faces of said body is one longitudinal alignment recess.

9. The block as defined in claim 1, wherein said at least one longitudinal alignment recess in each side face of said pair of opposing side faces of said body is a pair of longitudinal alignment recesses.

* * * * *